US008087252B2

(12) United States Patent
De Sousa et al.

(10) Patent No.: US 8,087,252 B2
(45) Date of Patent: Jan. 3, 2012

(54) TURBOMACHINE COMBUSTION CHAMBER

(75) Inventors: Mario César De Sousa, Cesson (FR); Morgan Robin, Yerres (FR)

(73) Assignee: SNECMA, Paris (FR)

( * ) Notice: Subject to any disclaimer, the term of this patent is extended or adjusted under 35 U.S.C. 154(b) by 1204 days.

(21) Appl. No.: 12/016,469

(22) Filed: Jan. 18, 2008

(65) Prior Publication Data

US 2009/0293487 A1 Dec. 3, 2009

(30) Foreign Application Priority Data

Jan. 18, 2007 (FR) ..... 07 00325

(51) Int. Cl.
*F02C 7/20* (2006.01)

(52) U.S. Cl. ..... 60/796; 60/799

(58) Field of Classification Search ..... 60/804, 60/796, 799, 800, 752
See application file for complete search history.

(56) References Cited

U.S. PATENT DOCUMENTS

| | | | | |
|---|---|---|---|---|
| 638,290 | A * | 12/1899 | Smith | 238/218 |
| 5,224,825 | A * | 7/1993 | Strang et al. | 415/209.3 |
| 5,524,430 | A * | 6/1996 | Mazeaud et al. | 60/798 |
| 7,673,457 | B2 * | 3/2010 | Bessagnet et al. | 60/752 |

FOREIGN PATENT DOCUMENTS

| | | |
|---|---|---|
| EP | 1 431 665 A2 | 6/2004 |
| EP | 1 717 516 A1 | 11/2006 |
| FR | 2 887 015 | 12/2006 |
| GB | 2 252 152 A | 7/1992 |
| GB | 2 263 733 A | 8/1993 |

* cited by examiner

*Primary Examiner* — Ehud Gartenberg
*Assistant Examiner* — Vikansha Dwivedi
(74) *Attorney, Agent, or Firm* — Oblon, Spivak, McClelland, Maier & Neustadt, L.L.P.

(57) ABSTRACT

An annular combustion chamber for a turbomachine is disclosed. The combustion chamber includes radially internal and radially external cylindrical walls which are fixed by bolting at their upstream ends to an internal and an external annular flange of an annular chamber end wall, and an annular fairing extending in the upstream direction from the chamber end wall. The internal and external annular ends are fixed by bolting to the flanges of the chamber end wall in axial alignment with the annular ends of the walls of the chamber.

10 Claims, 2 Drawing Sheets

TURBOMACHINE COMBUSTION CHAMBER

BACKGROUND OF THE INVENTION

The present invention relates to an annular combustion chamber for a turbomachine, such as an airplane turbojet or turboprop engine.

An annular combustion chamber of a turbomachine comprises two coaxial cylindrical walls connected at their upstream ends to a very rigid annular chamber end wall and comprising, at their downstream ends, flanges for fixing to casings of the turbomachine. It also comprises an upstream annular fairing fixed to the chamber end wall and intended to direct the stream of air entering or bypassing the combustion chamber.

DESCRIPTION OF THE PRIOR ART

In the known art, the upstream part of the combustion chamber is assembled by superposing the radially internal and external downstream ends of the fairing with, respectively, the radially internal and external upstream ends of the cylindrical walls of the chamber, the assembly being fixed by bolting or welding onto respectively radially internal and external annular flanges of the chamber end wall. A bolted connection is generally preferred because the maintenance operations performed on the combustion chamber are then simpler and less expensive than is the case with a welded connection.

Assembling the upstream part of the combustion chamber by radially superposing the ends of the fairing and the cylindrical walls with the chamber end wall flanges results in a build-up of manufacturing tolerances which are generally large in the case of parts exhibiting symmetry of revolution and in the stiffnesses of each of the parts being combined with one another. As a result, a screw/nut fastening system has to be tightened firmly enough to compensate for the sum of these tolerances and the sum of these forces, and such a level of tightening may exceed the acceptable limit for the screws and/or lead to plastic deformation of the fairing and of the cylindrical walls in particular, thus reducing the mechanical integrity and the life of the combustion chamber. Deformation of the parts may also cause gaps to appear between the fairing and the walls, thus creating air leaks. Furthermore, when the turbomachine is running, the chamber is subjected to high levels of vibration which may cause slippage of the parts (fairing, chamber walls and end wall) relative to one another if fasteners are lost.

When the tightening torque is unable to compensate for the stiffnesses and mounting tolerances of the parts, the parts cannot be mated together correctly, and this means that the necessary reactions between the parts will be insufficient to transfer, through friction, the forces that pass through the turbomachine when it is in operation. This means that the parts will be able to slip more easily. Turbomachine vibrations may then damage the bolted connection, particularly the screws, leading to an increased loss of fasteners and destruction of the parts starting from the joint.

In order to obtain the flexibility needed for a good mechanical joint in the combustion chamber upstream end parts, it has been proposed to produce axial slots in the ends of the fairing between the fixing bolts. However, these slots give rise to additional airflows around the chamber, disrupting the airflow and therefore the overall operation of the turbomachine. In addition, the ends of these slots are sensitive to turbomachine vibrations, thus weakening the fairing.

In another technique, the parts of the fairing, the superposed ends of the cylindrical walls and of the chamber end wall have complementary undulating surfaces, the fixings being fastened in the clefts of the undulations. This known solution makes it easier to mate the parts together but creates deformations upon tightening with a risk of air leaks.

SUMMARY OF THE INVENTION

A subject of the present invention is a combustion chamber for a turbomachine which avoids the aforementioned disadvantages of the prior art in a simple, effective and economical way.

To this end, the invention proposes an annular combustion chamber for a turbomachine, comprising two cylindrical walls these being respectively radially internal and radially external with respect to the axis of the turbomachine and fixed by bolting at their upstream ends to an internal annular flange and an external annular flange of an annular chamber end wall, and an annular fairing extending in the upstream direction from the chamber end wall, wherein the internal and external downstream annular ends of the fairing are fixed by bolting respectively to the internal and external annular flanges of the chamber end wall in axial alignment with the annular ends of the internal and external walls of the chamber.

The upstream end of the combustion chamber is thus assembled by radially superposing two parts rather than three parts, thus reducing the combined stiffness and the build-up of manufacturing tolerances. The tightening torque that needs to be applied to the bolts can be optimized and the radial deformations of the chamber when the fairing and the walls respectively are fixed to the end wall are reduced.

According to another feature of the invention, the aligned ends of the fairing and of the cylindrical walls of the combustion chamber have complementary indentations or undulations which fit into one another and through which fixing bolts for connecting to the chamber end wall pass.

These indentations or undulations give the fairing and the cylindrical walls a certain radial flexibility making them easier to fix to the end wall. Furthermore, the risk of the parts sliding relative to one another if the fixing bolts break is greatly reduced by the use of fairing and wall shapes that complement each other and by the independent fixings of the fairing and of the walls to the chamber end wall.

The indentations or undulations of the ends of the fairing and of the cylindrical walls comprise an alternation of solid parts and hollow parts, the fixing bolts passing through the solid parts and being distributed in an annular row on the external annular end of the fairing and on the corresponding end of the external wall of the chamber, and an annular row on the internal annular end of the fairing and on the corresponding end of the internal wall of the chamber.

Arranging the bolts in an internal annular row and an external annular row makes it possible to reduce the axial space occupied.

Advantageously, the fixing bolts which connect the external annular end of the fairing and the annular end of the external wall are angularly offset with respect to the fixing bolts which connect the internal annular end of the fairing and the annular end of the internal wall.

Thus, the configuration is such that a fixing bolt for the external downstream end of the fairing is not radially aligned with a fixing bolt for the internal downstream end of the fairing. An offset such as this makes it possible to avoid forming lines of radial deformation between the internal and external fixing bolts, thus contributing toward improving the rigidity of the combustion chamber and toward limiting the risk of resonance which could cause cracks to spread under the effect of vibration.

In one embodiment of the invention, each solid part of the indentations or undulations comprises a single fixing bolt through-hole.

In another embodiment of the invention, the solid parts of the indentations or undulations of the ends of the fairing comprise the same number of fixing bolts as the solid parts of the indentations or undulations of the ends of the walls of the chamber.

In an alternative form of embodiment, the solid parts of the indentations or undulations of the ends of the fairing comprise a number of fixing bolts that differs from that of the solid parts of the indentations or undulations of the ends of the walls of the chamber.

The annular fairing may be made of a single piece or of two annular pieces these respectively being a radially internal and a radially external piece.

The invention also relates to a turbomachine such as an airplane turbojet or turboprop engine and which comprises an annular combustion chamber of the type described hereinabove.

BRIEF DESCRIPTION OF THE DRAWINGS

Other advantages and features of the invention will become apparent from reading the following description which is given by way of nonlimiting example and with reference to the attached drawings in which.

DESCRIPTION OF THE PREFERRED EMBODIMENTS

Figure 1:
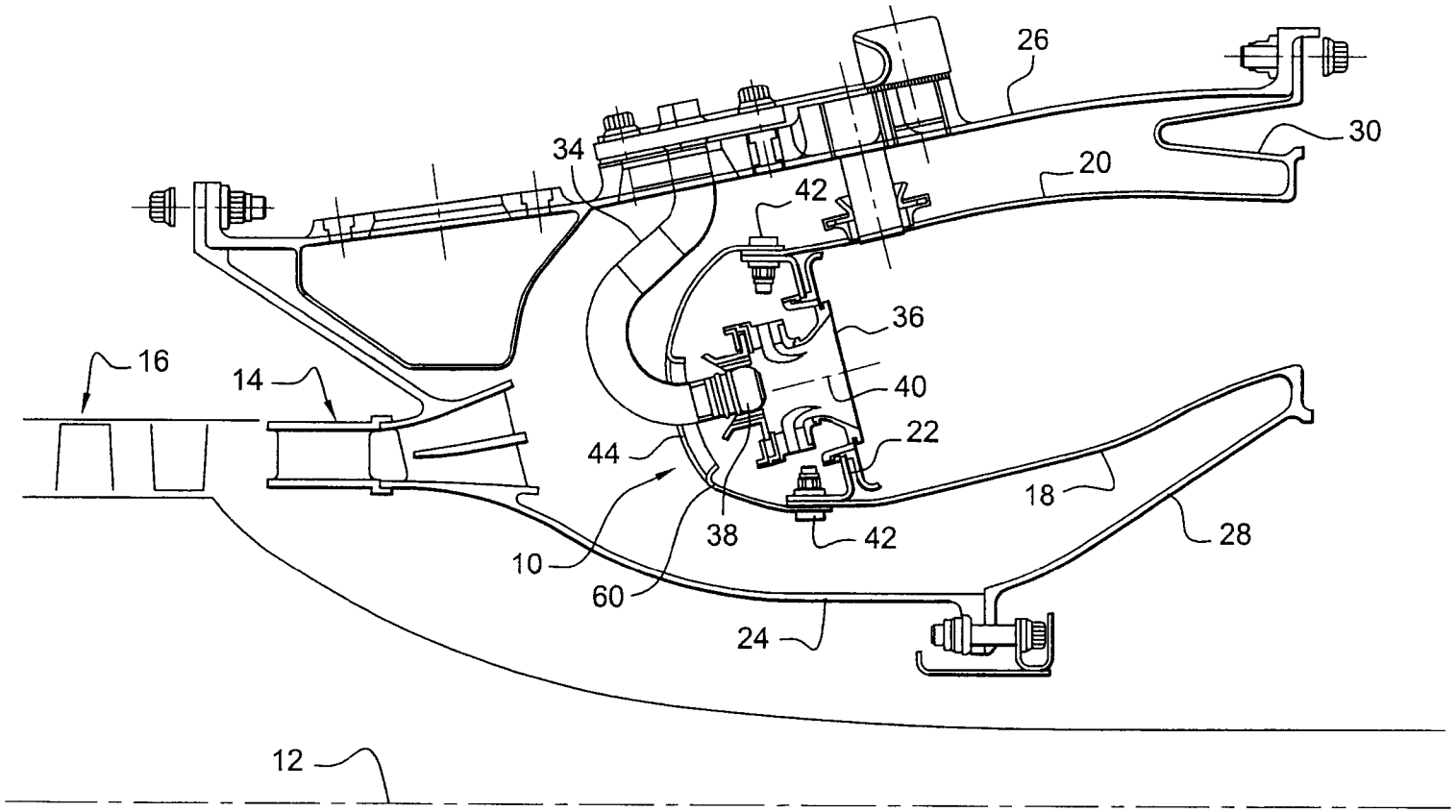
Fig. 1 Prior Art
FIG. 1 is a partial schematic half view in axial section of a turbojet engine combustion chamber according to the prior art.

Reference is made first of all to FIG. 1 which is a schematic half view of an annular combustion chamber 10 according to the prior art of the invention, viewed in section on the axis of rotation 12 of the turbomachine.

The combustion chamber 10 is supplied with air by a diffuser 14 mounted at the exit of a high-pressure compressor 16. It comprises a radially internal cylindrical wall 18 and a radially external cylindrical wall 20 which are connected upstream to an annular chamber end wall 22 and downstream to casings 24 and 26 by means of an internal annular flange 28 and an external annular flange 30, respectively.

The chamber end wall 22 comprises holes 36 through which air from the diffuser 14 and fuel sprayed by injectors 34 borne by the external casing 26 can pass. Each injector 34 comprises a head 38 mounted on the chamber end wall and aligned with the axis 40 of a hole 36. An annular fairing 60 which extends in the upstream direction and comprises through-holes 44 for the passage of air and of the injectors is fixed to chamber end wall flanges 22 with the ends of the cylindrical walls 18 and 20 of the combustion chamber.

Figure 2:
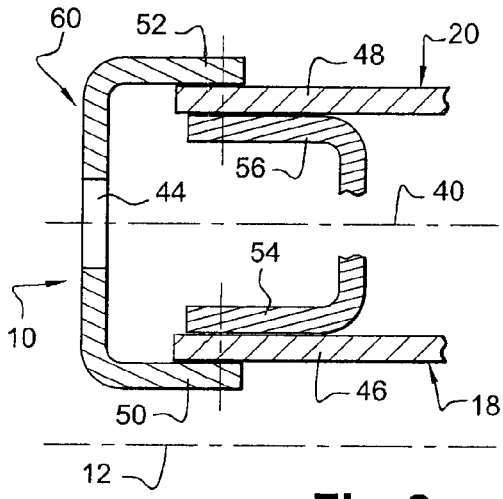
Fig. 2 Prior Art
FIG. 2 is a partial schematic view in axial section illustrating the assembly of the upstream end of the combustion chamber according to the prior art.

In the known art depicted in FIG. 2, the upstream part of the combustion chamber is assembled by inserting the internal 46 and external 48 ends of the cylindrical walls between, on the one hand, the internal 50 and external 52 annular ends of the fairing and, on the other hand, the internal 54 and external 56 annular flanges of the chamber end wall. These three parts thus superposed are fixed together using bolts 42, which results in a build-up of manufacturing tolerances and causes the stiffnesses to be combined with one another.

Figure 3:
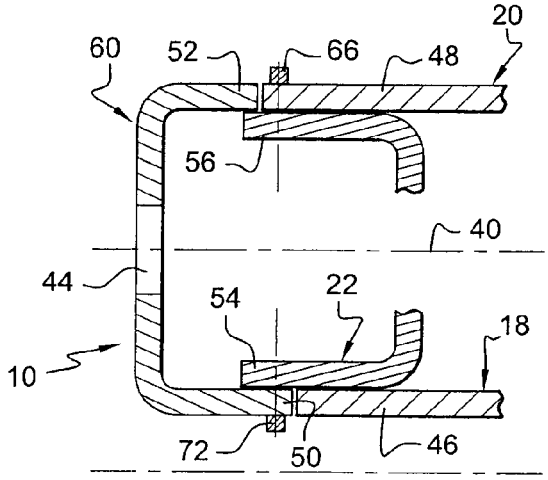
FIG. 3 is a partial schematic view in axial section illustrating the assembly according to the invention.

According to the invention, these disadvantages are avoided by virtue of the fact that, as depicted in FIG. 3, the internal 50 and external 52 downstream ends of the fairing are aligned respectively with the annular ends of the internal 46 and external 48 walls of the combustion chamber and are bolted to the flanges of the end wall independently of the ends of the walls 46 and 48.

The upstream part of the chamber is thus assembled by a radial superposition of two parts rather than three parts. As a result, the impact that the build-up of manufacturing tolerances and the combination of respective stiffnesses of the fairing, of the walls and of the end wall has is lower thus making it easier to assemble the chamber and improving the mechanical integrity of the assembly. The tightening torque that has to be applied to the fixing bolts that connect the fairing to the flanges of the end wall can be optimized to account solely for the stiffnesses and manufacturing tolerances of the fairing and of the end wall. Likewise, in the fixing of the cylindrical walls to the chamber end wall flanges, only the stiffnesses and manufacturing tolerances of the walls and of the end wall of the chamber are taken into consideration. This assembly makes it possible to limit the radial deformations of the fairing and of the cylindrical walls and avoid the formation of additional air leaks which disturb combustion and airflow.

Figure 4:
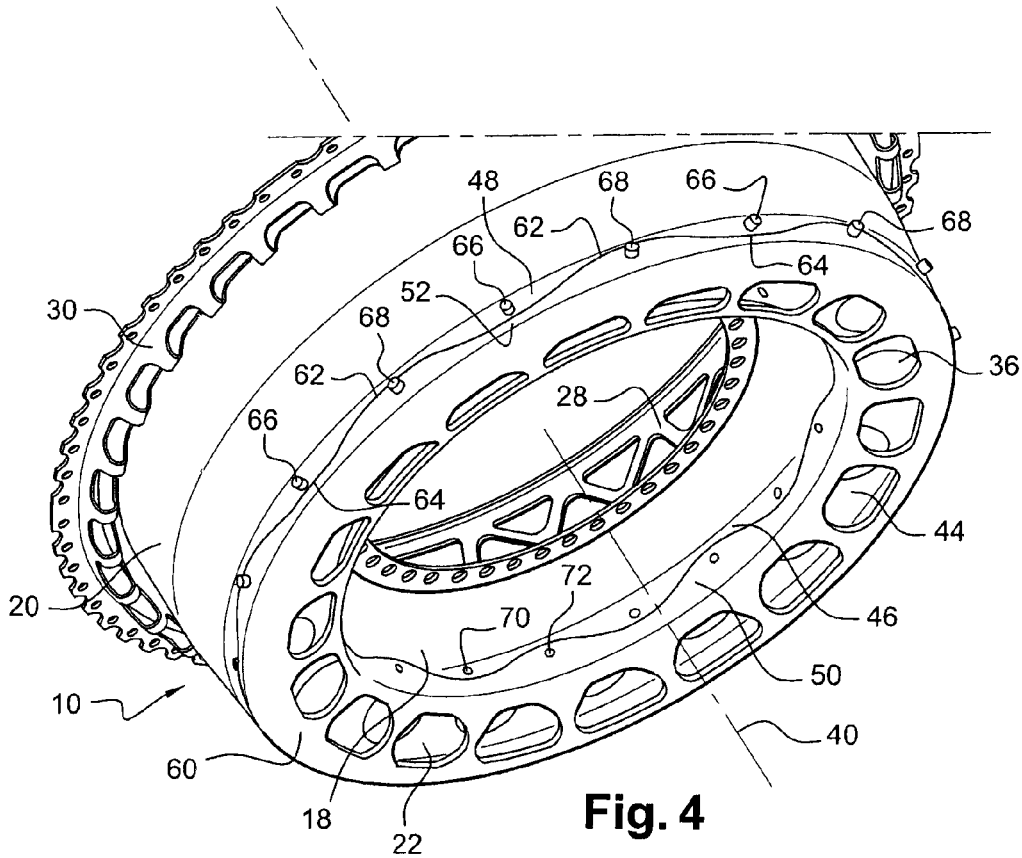
FIG. 4 is a partial perspective view of one embodiment of a combustion chamber according to the invention.

In the exemplary embodiment depicted in FIGS. 3 and 4, the upstream ends of the internal 18 and external 20 cylindrical walls have undulations or indentations formed by an alternation of hollow parts 62 and solid parts 48 which run in line with these walls. Likewise, the internal 50 and external 52 downstream ends of the fairing have undulations formed by an alternation of hollow parts 64 and solid parts 50. The hollow parts 62 and the solid parts 48 of the cylindrical walls engage in the solid parts 50 and hollow parts 64, respectively, of the annular fairing. These undulations give the cylindrical walls and the fairing some radial flexibility making them easier to fix to the end wall. The use of complementary shapes at the ends of the fairing and on the cylindrical walls and nesting them together allows the chamber better to withstand the vibrations of the turbomachine.

The fixing bolts on the chamber end wall pass through the solid parts of the undulations and are distributed in an external annular row and an internal annular row. The external annular row is formed by an alternation of fixing bolts 66 connecting the external cylindrical wall to the chamber end wall flange 56 and of fixing bolts 68 connecting the external upstream annular end of the fairing to this flange. Likewise, the internal annular row of bolts is formed by an alternation of fixing bolts 70 connecting the internal cylindrical wall and of fixing bolts 72 connecting the internal upstream annular end of the fairing to the chamber end wall flange 54.

Advantageously, the fixing bolts 68 for connecting the external annular end 52 of the fairing are angularly offset by one spacing with respect to the fixing bolts 72 for fixing the internal annular end of the fairing, and the bolts 66 and 72, and the bolts 68 and 70, are radially aligned. This method of attachment with an angular offset has the advantage of stiffening the combustion chamber as a whole while at the same time preventing the formation of lines of deformation between an internal bolt 72 and an external bolt 68 if these were diametrically opposed. The natural frequencies of vibration are thus higher making it possible to eliminate the risks of cracks spreading under the effect of vibration.

In the embodiment depicted in FIG. 3, each solid part of the indentations or undulations has a single through-hole for a fixing bolt.

In alternative forms of embodiment which have not been depicted, the solid parts of the undulations at the ends of the fairing have either the same number, for example 2, or a different number of fixing bolts, as the solid parts of the undulations at the ends of the walls of the chamber.

The annular fairing may be made as a single piece or alternatively be made as two annular pieces, these being a radially internal and a radially external piece.

The invention is not restricted to the combustion chambers described hereinabove and can be applied in general to all types of combustion chamber such as, for example, those designed to accept a number of injector heads arranged in concentric rings.

The invention claimed is:

1. An annular combustion chamber for a turbomachine, comprising:

radially internal and radially external cylindrical walls with respect to the axis of the turbomachine;

an annular chamber end wall with an internal annular flange and an external annular flange which are bolted to upstream ends of the radially internal and radially external cylindrical walls, respectively; and an annular fairing extending in the upstream direction from the chamber end wall, wherein internal and external downstream annular ends of the fairing are fixed by bolting respectively to the internal and external annular flanges of the chamber end wall in axial alignment with upstream annular ends of the internal and external walls of the chamber.

2. The combustion chamber as claimed in claim 1, wherein the internal and external downstream annular ends of the fairing and internal and external upstream annular ends of the cylindrical walls of the chamber have complementary indentations or undulations which fit into one another, the fixing bolts for connecting the fairing and the cylindrical walls to the chamber end wall passing through the indentations of the fairing and through the indentations of the cylindrical walls.

3. The combustion chamber as claimed in claim 2, wherein the indentations or undulations comprise an alternation of solid parts and hollow parts, the fixing bolts passing through the solid parts and being distributed in an annular row on the external annular end of the fairing and on the corresponding end of the external wall of the chamber, and an annular row on the internal annular end of the fairing and on the corresponding end of the internal wall of the chamber.

4. The combustion chamber as claimed in claim 3, wherein each solid part of the indentations or undulations comprises a single fixing bolt through-hole.

5. The combustion chamber as claimed in claim 3, wherein the solid parts of the indentations or undulations of the ends of the fairing comprise the same number of fixing bolts as the solid parts of the indentations or undulations of the ends of the walls of the chamber.

6. The combustion chamber as claimed in claim 3, wherein the solid parts of the indentations or undulations of the ends of the fairing comprise a number of fixing bolts that differs from that of the solid parts of the indentations or undulations of the ends of the walls of the chamber.

7. The combustion chamber as claimed in claim 1, wherein the fixing bolts which connect the external annular end of the fairing and the annular end of the external wall are angularly offset with respect to the fixing bolts which connect the internal annular end of the fairing and the annular end of the internal wall.

8. The combustion chamber as claimed in claim 1, wherein the annular fairing is made of a single piece or of two annular pieces these respectively being a radially internal and a radially external piece.

9. A turbomachine such as an airplane turbojet or turboprop engine and which comprises an annular combustion chamber as claimed in claim 1.

10. The combustion chamber as claimed in claim 1, wherein axial upstream ends of the upstream annular ends of the internal and external walls of the chamber face axial downstream ends of the internal and external downstream annular ends of the fairing, respectively.

* * * * *